US005898178A

United States Patent [19]

Bunker

[11] Patent Number: 5,898,178

[45] Date of Patent: Apr. 27, 1999

[54] ION SOURCE FOR GENERATION OF RADIOACTIVE ION BEAMS

[75] Inventor: Stephen N. Bunker, Wakefield, Mass.

[73] Assignee: Implant Sciences Corporation, Wakefield, Mass.

[21] Appl. No.: 08/887,504

[22] Filed: Jul. 2, 1997

[51] Int. Cl.[6] ..... H01J 49/04

[52] U.S. Cl. ..... 250/423 R

[58] Field of Search ..... 250/423 R, 424, 250/425, 426, 423 F, 427, 492.2, 492.21

[56] References Cited

U.S. PATENT DOCUMENTS

| | | | |
|---|---|---|---|
| 3,992,632 | 11/1976 | Kruger et al. | 250/423 R |
| 4,045,677 | 8/1977 | Humphries, Jr. et al. | 250/423 R |
| 4,124,802 | 11/1978 | Terasawa et al. | 250/492 A |
| 4,175,234 | 11/1979 | Hunt et al. | 250/423 R |
| 4,321,467 | 3/1982 | Buttrill, Jr. | 250/423 R |
| 4,465,524 | 8/1984 | Dearnaley et al. | 148/31.5 |
| 4,584,991 | 4/1986 | Tokita et al. | 128/1.1 |
| 4,586,490 | 5/1986 | Katz | 128/1.1 |
| 4,660,547 | 4/1987 | Kremer, Jr. | 128/1.1 |
| 4,714,074 | 12/1987 | Rey et al. | 128/1.1 |
| 4,715,359 | 12/1987 | Ryo | 128/1.1 |
| 4,803,977 | 2/1989 | Kremer, Jr. | 600/3 |
| 4,815,446 | 3/1989 | McIntosh | 600/3 |
| 4,831,270 | 5/1989 | Weisenberger | 250/492.2 |
| 4,869,835 | 9/1989 | Ogawa et al. | 250/423 R |
| 4,872,922 | 10/1989 | Bunker et al. | 148/4 |
| 4,881,937 | 11/1989 | van't Hooft et al. | 600/3 |
| 4,881,938 | 11/1989 | van't Hooft | 600/3 |
| 4,946,435 | 8/1990 | Suthanthiran et al. | 600/3 |
| 4,969,863 | 11/1990 | van't Hooft et al. | 600/3 |
| 5,030,194 | 7/1991 | van't Hooft | 600/3 |
| 5,047,648 | 9/1991 | Fishkin et al. | 250/492.2 |
| 5,059,166 | 10/1991 | Fishell et al. | 600/3 |
| 5,176,617 | 1/1993 | Fishell et al. | 600/3 |
| 5,393,986 | 2/1995 | Yoshinouchi et al. | 250/492.21 |
| 5,644,130 | 7/1997 | Raatz | 250/423 R |

OTHER PUBLICATIONS

Hessel et al, "Angiography and Vasa Vasorum Blood Flow after Aortic Dilation," *Investigative Radiology* (Sep.–Oct.) p. 404 (1978).

Goldberg et al, "In Vivo Aortic Smooth Muscle Cell (SMC) Kinetics: Responnse to Irradiation in the Rat," *Cell Tissue Kinet*, vol. 15, No. 6, p. 675 (1982).

Lee et al, "Effects of Laser Irradiation on Cardiac Valves Technique of Trans Catheter in Vivo Vaporization of Aortic Valve," *Laser Surg. Med.* vol. 3, No. 2, pp. 174–175 (1983).

Lee et al, "Laser Irradiation of Human Atherosclerotic Obstructive Disease: Simultaneous Visualization and Vaporization Achieved by a Dual Fiberoptic Catheter," *American Heart Journal*, vol. 105, No. 1, pp. 163–64 (1983).

Lee et al, "Effects of Laser Irradiation on Cardiac Valves Trans Catheter in Vivo Vaporization of Aortic Valve," *American Heart Journal*, vol. 107, p. 394 (Feb. 1984).

(List continued on next page.)

*Primary Examiner*—Kiet T. Nguyen
*Attorney, Agent, or Firm*—Foley, Hoag & Eliot LLP

[57] ABSTRACT

An ion source is described for use with conventional and modified ion implantation equipment to improve safety and increase efficiency when generating radioactive ion beams. The ion source is particularly useful with radioactive species that are volatile at room temperature or react with air molecules to form volatile compounds. One or more components of the ion source, such as a cathode, an anode, an electrostatic electron reflector, a vaporizer, a sputter target, a gas line or a plasma chamber, may be mounted on extensible probes within radiation shielded sealable transfer containers. Other components of the ion source may be fixed in a vacuum chamber, which may have one or more valved openings corresponding to the sealable openings in the transfer containers. The components on the probes may be extended into position inside the vacuum chamber for operation of the ion source, and may be retracted into the sealable transfer containers and transported to an area for servicing or repair.

11 Claims, 6 Drawing Sheets

OTHER PUBLICATIONS

Solomon et al, "An In Vivo Method for the Evaluation of Catheter Thrombogenicity," *Journal of Biomedical Materials Research*, vol. 21, pp. 43–57 (1987).

Rosch et al, "Gianturco Expandable Wire Strents in the Treatment of superior Vena Cava Syndrome Recurring after Maximum Tolerance Radiation," *Cancer* (Phila), vol. 60, No. 6, pp. 1243–1246 (1987).

Daniel et al, "A New Rapid Safe Method for Local Radiation of Intrathoracic Sites," *Am. Surg.*, vol. 55, No. 9, pp. 560–562 (1989).

Tim A. Fishell, MD et al., "Low–Dose β–Particle Emission From 'Stent' Wire Results in Complete, Localized Inhibition of Smooth Muscle Cell Proliferation" in Circulation 90 pp. 2956–2963 (1994).

Armini, "Formation of New Surface Alloys by Ion Implantation Technology," Article produced by Implant Sciences Corporation, Danvers, Massachussets 01923, (Jan., 1986).

Janicki et al., "Production and Quality Assessment of Beta Emitting P–32 Stents for applications in Coronary Angioplasty," Paper submitted to the 42nd Annual Meeting of the Canadian College of Physicist in Medicine, Jun. 20–22, 1996, University of British Columbia, Vancouver, Canada.

ION SOURCE FOR GENERATION OF RADIOACTIVE ION BEAMS

TECHNICAL FIELD

This application relates to the field of ion beams and more particularly to the field of ion implantation using radioactive ion beams.

BACKGROUND OF THE INVENTION

Ion implanted beams of certain radioactive elements are useful for commercial applications. However, radioactive elements which are not converted to an ion beam may condense inside the vacuum chamber of the ion implanter, particularly in the vicinity of the ion source. Such radioactive deposits may be volatilized as a gas or as a fine airborne dust when the ion source is opened to the air for maintenance, which is a hazardous condition to be avoided.

One useful application of ion beams is to ion implant a radioactive species into surgical components in order to inhibit the regrowth of tissue in a local area. One such component is an intra-arterial stent used subsequent to balloon angioplasty to maintain arterial patency.

Sources of beta radiation ion implanted into the stent wires have been found to inhibit intimal hyperplasia that causes decreased arterial patency. Use of such beta radiation ion implanted stent wires thus reduces the chance of restenosis or reclosure of the artery subsequent to balloon angioplasty or atherectomy The ion implanted atoms cannot be removed accidentally from the component, as might be the case for a coating that peels off, and yet the atoms are positioned near enough to a surface to allow easy exit of the radiation from the component.

An article entitled "Low-Dose, β-Particle Emission from 'Stent' Wire Results in Complete, Localized Inhibition of Smooth Muscle Cell Proliferation," by Fischell et al. (the Fischell article) reports the benefits that can be achieved by using phosphorous impregnated stent wire. The Fischell article confirms that the ideal radioisotope to use for coating an arterial stent would be a beta emitter with a half-life of between 10 hours and 100 days. A beta emitter is ideal because the radiation does not penetrate very far through human tissue, thereby reducing the risk of damage to non-proliferating tissue.

Several techniques are available for ion implantation to firmly embed nonradioactive atoms into workpieces. For example, U.S. Pat. No. 4,465,524 by Dearnaley et al. (the '524 patent) describes a method of coating a workpiece made of titanium or an alloy of titanium with a layer of metal, such as tin or aluminum. The metal layer is then bombarded with ions of a species such as nitrogen, carbon, boron or neon, thereby causing the metal to migrate into the titanium. The '524 patent discloses that the modified surface has an improved wear resistance and a reduced coefficient of friction.

Similarly, U.S. Pat. No. 4,831,270 to Weisenberger (the '270 patent) describes an ion implantation system for manufacturing semiconductors. In the ion implantation system of the '270 patent, semiconductor wafers are presented horizontally to an ion beam that impacts the wafers from above. The semiconductor wafers are loaded and unloaded using a wafer transfer station that includes a robot, an evacuatable transporter, and a transfer port that can be sealed with a port on the ion implantation enclosure. The '270 patent indicates that the semiconductor wafers can be doped with boron, phosphorus or arsenic dopant ions. The apparent purpose of the wafer transfer station is to reduce the opportunity for surface particle contamination of the wafers.

U.S. Pat. No. 4,872,922 by Bunker et al. (the '922 patent) describes a method and an apparatus for ion implantation of spherical surfaces using a fixture mounted for motion about two axes normal to each other and a specially adapted work station of an ion beam implanter. The '922 patent discloses using a broad electrostatically scanned ion beam of Ti and C or Ta, which are nonradioactive. The '922 patent indicates that it is important to clean the fixture as well as the spherical workpieces of all surface contamination before operating the ion implanter. The '922 patent suggests that the fixture be cleaned using mechanical abrasion with swabs.

Conventional ion implantation equipment is not designed for use with radioactive materials. The equipment is not adequately radiation shielded, and the need for frequent maintenance of the ion source would be a major safety problem. The ion source of a conventional ion implantation system contains the radioactive feedstock as well as most of the radioactive waste that is not converted to ions.

Useful radioactive species such as phosphorous-32 ($^{32}P$) are particularly hazardous because the ion source only ionizes and accelerates about 1% of the phosphorus vapor produced. The remaining phosphorus vapor is generally condensed on cold surfaces near the ion source as white phosphorus, a solid form of elemental phosphorus which has a significant vapor pressure at room temperature and is well-known to be strongly reactive with oxygen. White phosphorus is a known airborne health hazard even when it is not radioactive. The maximum allowable concentration in air is 0.1 mg/m$^3$. The oxides produced by the spontaneous burning of white phosphorus are also highly toxic chemically.

An ion source intended to produce a radioactive $^{32}P$ ion beam will concurrently discharge into the vacuum system significant quantities of unused white phosphorus in a mixture of non-radioactive $^{31}P$ and radioactive $^{32}P$. When the ion source requires regular servicing, for example to add fresh radioactive feedstock or to replace a consumable component such as a tungsten cathode, the phosphorus coated walls can release radioactive gas into the environment, creating a major safety hazard.

An ion source that has been creating phosphorus vapor also emits a pungent odor when opened to air. In addition, if a vacuum system is raised to atmospheric pressure or pumped to vacuum from atmosphere, even if an inert gas is employed, a significant wind exists until the vacuum system reaches pressure equilibrium. Such a wind disperses radioactive particles throughout the system and coats radioactive dust on surfaces that would not normally be contaminated. Therefore, use of radioactive species such as $^{32}P$ in an ion implanter is a difficult safety problem due to airborne radioactive vapors and particles.

There are fewer conventional techniques for ion implantation using radioactive ions than there are for nonradioactive ions. One example of a technique for ion implantation of a radioactive ion beam is U.S. Pat. No. 4,124,802 by Terasawa et al. (the '802 patent), which is directed to a method and device for ionizing radioactive gas such as Kr-85, accelerating the ionized radioactive gas into a high energy form, then implanting the high energy radioactive gas in a base material such as a band-shaped stainless steel foil. The radioactive ion implantation technique described in the '802 patent is designed for use in waste disposal of radioactive gases from nuclear reactors.

The ion implantation system of the '802 patent to Terasawa et al. for Krypton-85 is simple in its maintenance requirements for the ion source because unused radioactive feedstock gas can be almost completely removed from the ion implanter by the pumping/recovery system since it is an inert, non-condensible gas. Thus, the ion source retains essentially no radioactivity and any radioactivity that is present is not likely to be airborne during maintenance. However, the ion implantation system of the '802 patent is not optimal for a source that is not a gas at room temperature, such as phosphorous. Waste feedstock materials of phosphorus, for example, could condense as a solid phosphorus coating inside the ion implanter, making it more difficult to repair and maintain the ion source. Such radioactive phosphorus residue is an unsealed radioactive source, and phosphorus can readily become airborne as a gas or dust.

U.S. Pat. No. 5,059,166 by Fischell et al. (the '166 patent) describes a technique for causing a helical spring stent to be radioactive prior to insertion into the artery. The '166 patent discusses various techniques for causing the stent to be radioactive, including using radioisotopes in the manufacture of the stent and/or plating the stent with a radioisotope coating. Although the '166 patent generally describes a process for making the stent radioactive, it may be assumed that using radioisotopes and/or applying a radioactive coating would require handling of radioactive material in a manner which may be unacceptable for mass production purposes.

An alternative approach for creating a radioactive stent involves using a cyclotron to bombard stainless steel stents with a proton beam to produce radioactive isotopes within the stent. However, these isotopes have high-energy gamma emissions and long half-lives that make this technique impractical for humans. Gamma emissions increase the whole-body dose of radiation while having relatively little therapeutic effect on local tissue compared to the effect of beta emissions. In addition, it has been found that long half-life materials are less appropriate since optimum radioactivity-mediated inhibition is more likely to be achieved by a continuous exposure for the first few weeks following the insertion of the stent. Accordingly, a half-life of a few weeks (i.e., one to seven weeks) is deemed ideal for this purpose.

Another technique for manufacturing radioactive stents involves first implanting massive doses of $^{31}P$ in titanium stents. The $^{31}p$ is subsequently activated by a nuclear reactor to produce $^{32}P$. However, this technique requires up to thirty atomic percent $^{31}P$ under the surface of the titanium stent, which alters the chemical composition of the alloy with unpredictable effects on the mechanical and biocompatibility properties of the stent. In addition, the titanium metal stent may have impurities which, when bombarded in a nuclear reactor, create isotopes that emit substantial gamma rays and have long half-lives similar to the isotopes in the stainless-steel stents that are bombarded in a nuclear reactor.

An article entitled "Production and Quality Assessment of Beta Emitting P-32 Stents for Applications in Coronary Angioplasty", by Janicki et al. (the Janicki article) discusses using ion beam implantation to implant radioactive $^{32}P$ isotopes into a titanium stent. Although the ion beam implantation technique itself appears to result in a radioactive stent having acceptable characteristics, the Janicki article discloses performing the ion beam implantation using radioactive cathodes that are prepared using radioactive salts that are first dissolved into liquids and then dried onto the cathode. Handling the thus-formed radioactive liquids may be unacceptable for mass production. In addition, the resulting radioactive salts that are dried onto the cathode may fall off and contaminate workers in a mass production setting.

SUMMARY OF THE INVENTION

Airborne radioactive emission resulting from use of an ion-generating radioactive feedstock material may be minimized by minimizing the frequency with which the vacuum chamber for the ion source assembly is opened to air during its service lifetime. The present invention achieves this result by using a sealable enclosure in which one or more of the components of the ion source that require maintenance, servicing, or replacement may be mounted on one or more extensible probes inside one or more radiation-shielded transfer containers.

According to the present invention, an ion source for generation of a radioactive ion beam includes a vacuum chamber having an interior portion, a fixed portion disposed within the interior portion of the vacuum chamber and adapted to accept one or more ion source components, an enclosure disposed outside the vacuum chamber, including a transfer container having an opening, which preferably may be sealable, and an interior portion, and including radiation shielding, an extensible probe having a portion located in the interior portion of the transfer container, a moveable actuator having a first portion coupled to the extensible probe and a second portion coupled to the enclosure, and a sealable opening in fluid communication with said vacuum chamber and corresponding to the opening of said transfer container. In this configuration, the moveable actuator may be used to extend and retract the portion of the extensible probe through the sealable opening when the enclosure is coupled to the vacuum chamber. A moveable component may be mounted on the extensible probe without altering the vacuum in the ion source assembly.

A source of ion-generating radioactive feedstock material preferably may be coupled to the transfer container, but the source also may be fixed inside the vacuum chamber. The present invention is particularly useful for a source of ion-generating radioactive feedstock material that is substantially solid at room temperature. The radiation shielding may be aluminum, iron, tungsten and lead, or any combination or alloy thereof.

The extensible probes may be enclosed in a metal bellows or a sliding seal. The moveable component mounted on the extensible probe may include one or more of the following: a plasma chamber, a cathode, an anode, an electrostatic electron reflector, a vaporizer, a sputter target, or a gas line, or any combination thereof. The moveable actuator may include a linear translator, such as a conventional computer operated system or a suitable variation thereof.

Optionally, a platform with tapered edges or a joint with tapered sides may be coupled to the extensible probe. A guide with a beveled edge may be coupled to said transfer container. The moveable component may also have tapered sides, and the fixed component may include a plasma chamber with correspondingly tapered sides aligned with the tapered sides of the moveable component. The tapering and beveling features may facilitate alignment and frictional coupling of the moveable component within the vacuum chamber during operation of the ion source.

Additionally, the vacuum chamber may include an area for receiving the extensible probe as well as a substantially separate area for transmission of an ion beam. An extraction electrode and a ground electrode may be located in the transmission area. Separation of the receiving and transmission areas, and optional use of a pair of wings downstream of the plasma chamber, may help minimize leakage of radioactive gas into areas of the vacuum chamber outside the transmission area.

The ion source may optionally use a cold cathode discharge, a filament cathode and an arc discharge, a hollow cathode and an arc discharge, or a radio frequency discharge unit.

The ion source of the present invention may be assembled by mounting a component on the end of a probe in a radiation shielded container; closing the radiation shielded container; attaching the radiation shielded container to an ion source chamber; opening the radiation shielded container; and extending the probe to place the component in the desired position relative to the ion source chamber. The vacuum and venting connections may also be attached to the radiation shielded container and the radiation shielded container may then be evacuated to a pressure similar to that of the ion source chamber before opening the ion source chamber. Any services required by the component may be connected.

The ion source of the present invention may be disassembled by retracting the probe into a radiation shielded container connected to an ion source chamber; closing the ion source chamber; and closing the radiation shielded container. The container may then be vented with inert gas or with dry nitrogen, depending on whether the component is moisture sensitive.

Other objects, features, and advantages will occur to those skilled in the art from the following description of preferred embodiments and the accompanying drawings.

DETAILED DESCRIPTION OF THE PREFERRED EMBODIMENT

This invention results from a realization that some useful radioactive elements, such as $^{32}P$, are unstable in air and prone to becoming a radioactive vapor or dust. Since ion sources used to create an ion beam of phosphorus usually create a residue of waste condensible phosphorus on cold surfaces in the vacuum system, it is possible to avoid the problem of airborne radioactive materials by modifying a suitable conventional ion source to reduce the need to regularly return the vacuum system to air for maintenance or servicing of the components.

This may be accomplished by affixing the components of the ion source that routinely require maintenance onto extensible probes that can be passed into the ion source vacuum system and positioned into their appropriate locations in the source. When service is required, the components are removed in a manner described in detail below. Typical ion source components are a cathode, a vaporizer, a sputter target, an electrostatic electron reflector, an anode, and a plasma chamber. These components need not all be present in a given implementation of an ion source.

A cathode is a source of electrons and is commonly formed from a hot filament composed of tungsten or tantalum metal, although a so-called hollow cathode may also be employed. A vaporizer is a heated oven in which the radioactive feedstock may be placed. There is typically a connection between the vaporizer and the plasma chamber of the ion source to permit passage of gas created by heating the feedstock. The vaporizer may also be located within the plasma chamber and use a variety of heating methods to heat the feedstock. Electrical resistance heating is typically employed when the vaporizer is external to the plasma chamber of the ion source while waste heat from operation of the source or heat from ion bombardment may be employed when the source of feedstock vapor is within the plasma chamber.

A sputter target is an alternate source of feedstock vapor. Excess ions fill the plasma chamber and are made to bombard the sputter target because of an applied or induced voltage. Sputtering liberates surface atoms from the sputter target, effectively creating a vapor of the feedstock. An electrostatic electron reflector is a surface that is isolated by electrical insulation so it is not directly connected electrically to the anode or cathode. However, plasma bombardment may indirectly induce a voltage relative to the anode or cathode.

The anode may be the plasma chamber itself or an independent electrode in the plasma chamber or ion source structure. The plasma chamber is a container in which the plasma created by the ion source is maintained prior to extraction and acceleration.

Figure 1:
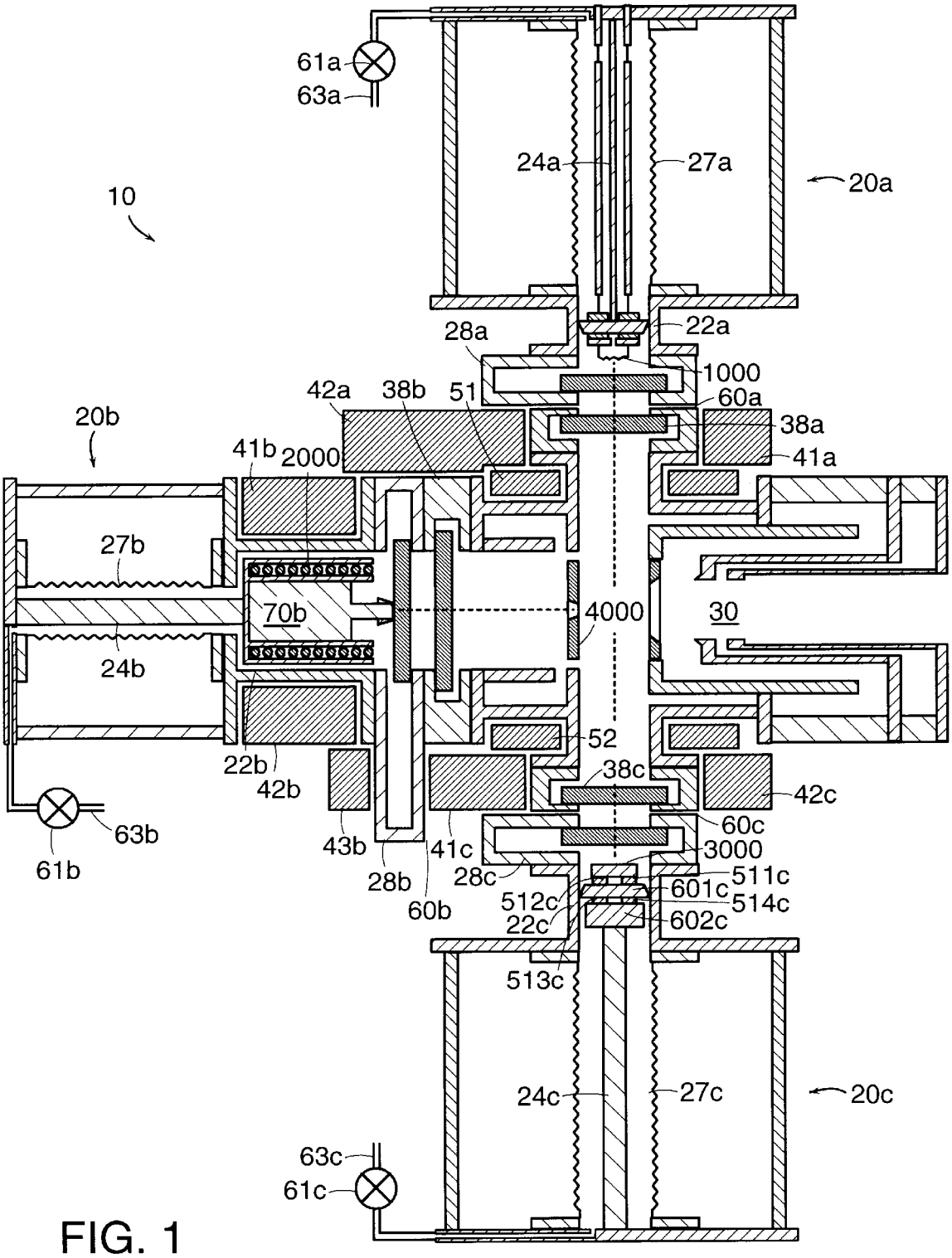
FIG. 1 is a schematic diagram of a cross-section of an ion source for accomplishing the method of this invention showing three extensible probes in a retracted position for servicing of the ion source.

FIG. 1 illustrates an embodiment of a common ion implanter ion source 10. The source 10 includes a vacuum chamber 30, a hot tungsten filament cathode 1000 that may become eroded with use, an electrostatic electron reflector 3000 having insulators 511*c*, 512*c*, 513*c*, 514*c* that may also become coated with conducting material, a vaporizer 2000 for a radioactive elemental solid phosphorus 70*b*, and a plasma chamber 4000. The cathode 1000 is on an extensible probe 24*c*. The vaporizer 2000 is on an extensible probe 24*b*. The electron reflector 3000 is on an extensible probe 24*c*. Three sealable transfer containers 22*a–c*, each having sealable openings 28*a–c*, provide the capacity for containing radiation and radioactive particulates in addition to maintaining an inert gas atmosphere during transfer to a service area. Other radiation shielding 41*a*, 42*a*, 41*b*, 42*b*, 43*b*, 41*c*, 42*c* may be used to protect individuals while transferring the transfer containers 22*a–c*. Three valved openings 38*a–c* on the vacuum chamber 30 seal the vacuum chamber 30 from air after the extensible probes 24*a–c* are retracted. All of the extensible probes 24*a–c* in FIG. 1 are shown in the retracted position. Preferably, the valved openings 38*a–c* on the vacuum chamber 30 can be sealed adequately to maintain the vacuum in the system. The ion source 10 also contains three bellows 27*a–c* surrounding the extensible probes 24*a–c*. Joints 60*a–c* may be used to fasten the sealable openings 28*a–c* to the valved openings 38*a–c*. A magnetic field may be superimposed on the plasma chamber 4000, emanating from ferrous material poles 51, 52. Hand-operated valves 61*a–c* may be connected to vacuum and inert gas venting connections 63*a–c*, which could connect to a combined external pumping/venting assembly (not shown). Preferably, the removable enclosures 20*a–c* will have a minimum of extra hardware attached so they will be easier to lift.

The device 10 may be used in the following manner. First, the component 1000 may be mounted on the end of the extensible probe 24*a*. Then, the extensible probe 24*a* may be retracted into the vacuum compatible radiation shielded transfer container 22*a* and the transfer container seal in the sealable opening 28*a* may be closed. The transfer container 22*a* may be transferred to the ion source vacuum chamber 30 and attached onto the valved opening 38*a*. The vacuum and inert gas venting connection 63*a* may be attached to the valve 61*a* on the transfer container 22*a* to evacuate the transfer container 22*a* to a pressure similar to that of the ion source vacuum chamber 30. The transfer container sealable opening 28*a* and the valved opening 38*a* may then be opened. The extensible probe 24*a* is extended until it is in the correct position in the ion source 10. Other services that may be required by the component, such as cooling fluid or electrical lines, are then connected in a conventional manner. If appropriate, other components of the ion source may be connected and the ion source may be operated.

Maintenance of the component 1000 may be provided by first retracting the extensible probe 24*a* into the transfer container 22*a* and closing the valved opening 38*a*. Services may then be disconnected and the transfer container 22*a* may be vented with inert gas. The sealable opening 28*a* on the transfer container 22*a* may then be closed. The vacuum and inert gas line 63*a* may be disconnected from the valve 61*a*. The transfer container 22*a* may be disengaged from the valved opening 38*a* and the transfer container 22*a* may be transferred to a service area where an inert atmosphere is provided and/or where suitable radiation shielding and remote manipulation hardware is available. Also, the transfer container 22*a* may be opened to either air or to dry nitrogen, depending on whether the component 1000 is moisture sensitive.

The other extensible probes 24*b–c*, transfer containers 22*b–c*, and components 2000, 3000 may be operated in a manner similar to that described above for the extensible probe 24*a*, transfer container 22*a*, and component 1000. The ion source vacuum chamber 30 may be connected to a vacuum chamber assembly for a mass filter (not shown).

Figure 2:
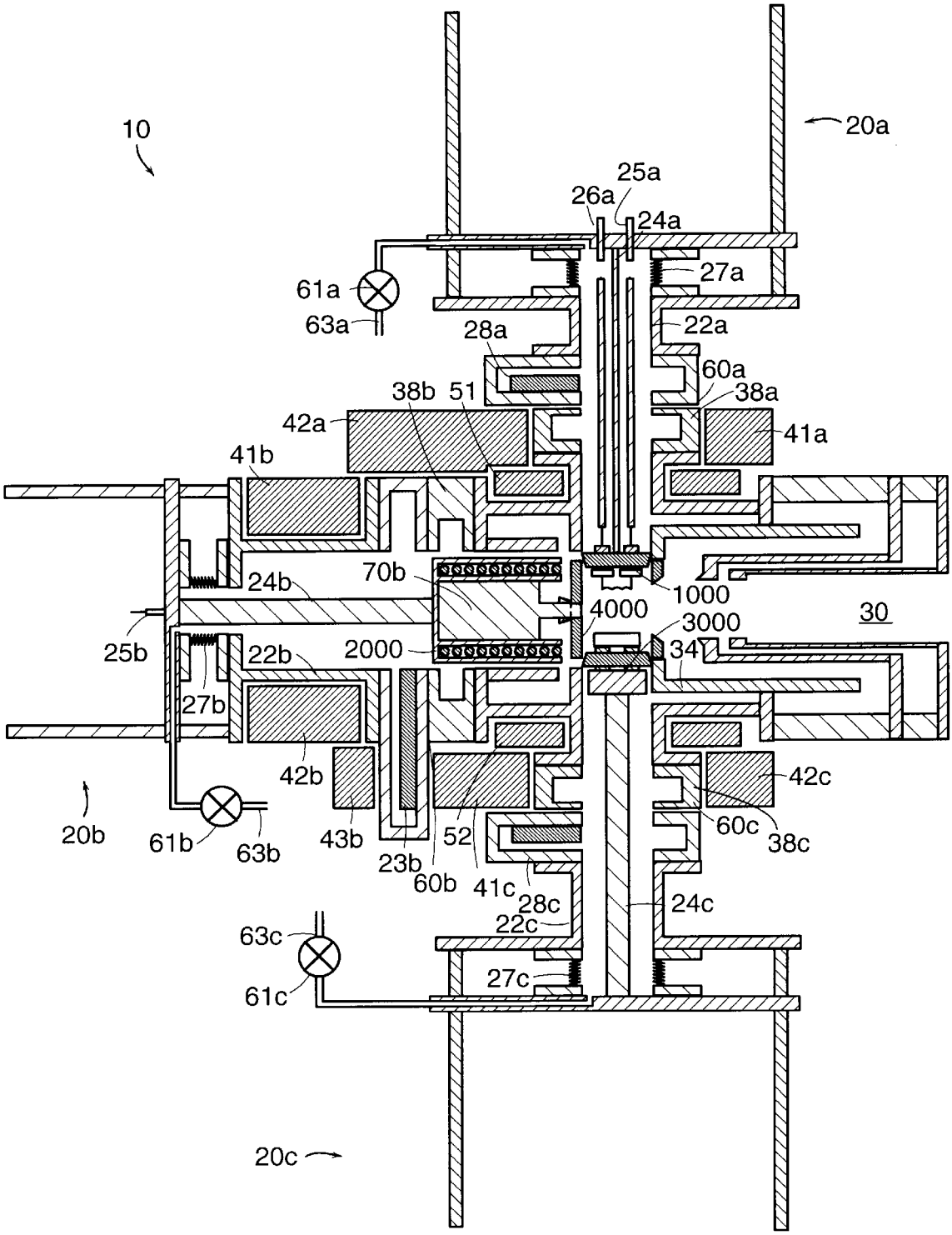
FIG. 2 is a schematic diagram of the ion source of FIG. 1 showing the extensible probes in an extended position for operation of the ion source.

FIG. 2 shows the ion source 10 of FIG. 1 in an operational position with the extensible probes 24*a–c* extended to connect with the plasma chamber 4000. In addition, the sealable openings 28*a–c* and the valved openings 38*a–c* are shown in an open position to facilitate extending the extensible probes 24*a–c*. The bellows 27*a–c*have been compressed and three connections 25*a*, 26*a*, 25*b* for services are shown. A baffle 34 also is shown in the ion source vacuum chamber 30. The shape of the baffle 34 and its location and placement within the ion source vacuum chamber 30 downstream of an orifice on the plasma chamber 4000 may help minimize leakage of radioactive phosphorus gas into areas of the ion source vacuum chamber 30 other than the zones where the ion beam must be transported. The ion source 10 may be operated in a conventional manner with a vacuum varying from approximately $10^{-5}$ torr where the ion beam hits the work piece (not shown) to approximately $10^{-2}$ torr in the plasma chamber 4000.

Figure 3:
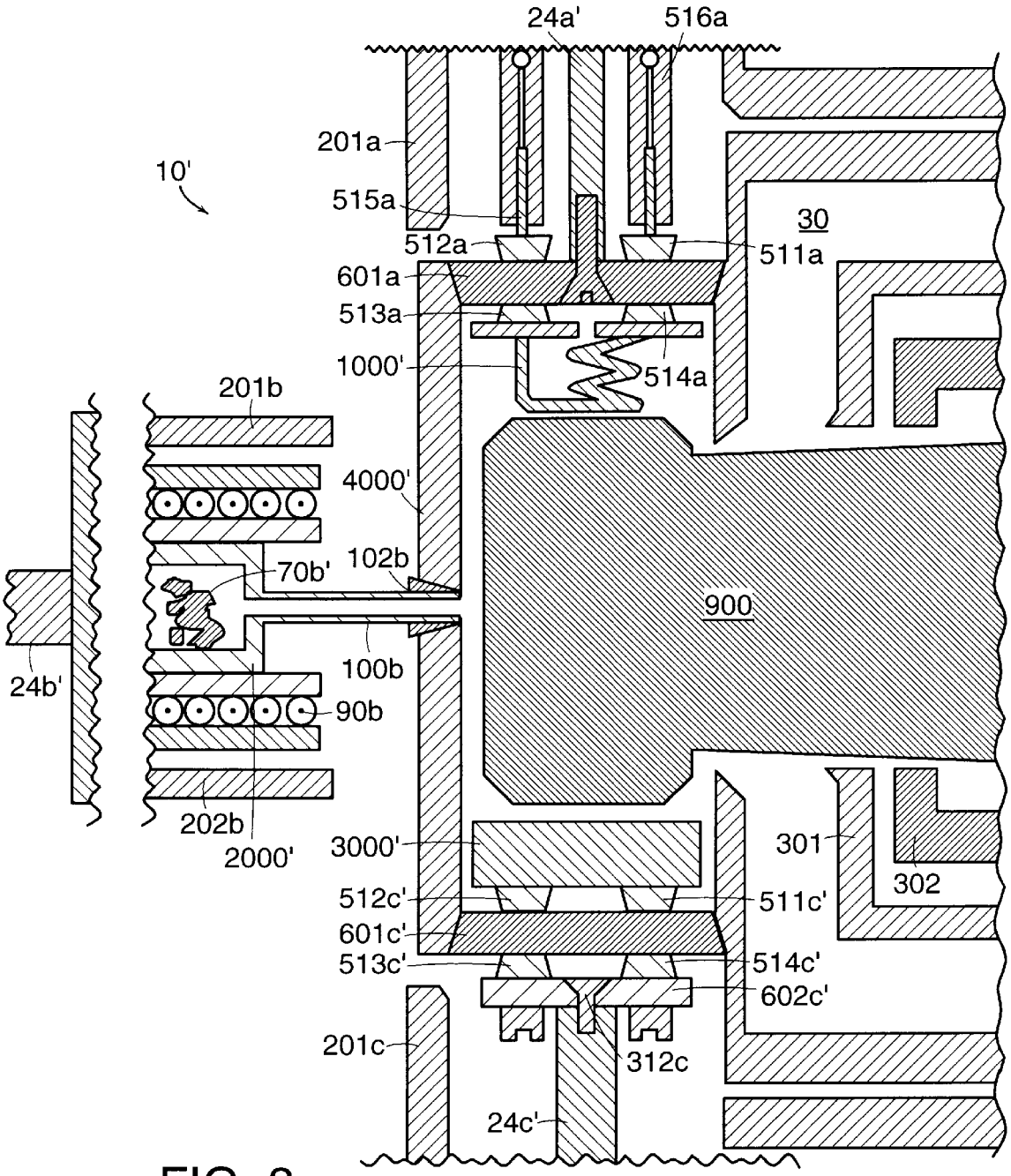
FIG. 3 is a schematic diagram illustrating an alternate embodiment for a plasma chamber of an ion source.

FIG. 3 shows an interior portion of an ion source 10' that uses a hot filament cathode 1000' with a plasma chamber 4000' acting as an anode. A vaporizer oven 2000' may contain a solid phosphorus-containing compound 70*b'* which may be elemental phosphorus. A heater 90*b* may be used to raise the temperature of the phosphorus material 70*b'* until a sufficient vapor pressure and gas flow of phosphorus is obtained to operate the ion source plasma chamber 4000'. Phosphorus vapor may be passed into the plasma chamber 4000' through a tube 10*b*. The vaporizer 2000' may be attached to an extensible probe 24*b'* and extended towards the plasma chamber 4000'. Alignment may be facilitated by a pair of guides 201*b*, 202*b*. The vaporizer 2000' may preferably be unioned, or temporarily joined, to the plasma chamber 4000' using tapered joint 102*b*, which may make a substantially gas-tight seal and may be self-aligning.

A cathode 1000' may be placed on the extensible probe 24*a'* and an electrostatic reflector 3000' may be placed on the extensible probe 24*c'*. The cathode 1000' and the electrostatic reflector 3000' may be mounted on taper joint platforms 601*a*, 601*c'* and may be electrically insulated with ceramic insulators 511*a*, 512*a*, 513*a*, 514*a*, 511*c'* , 512*c'*, 513*c'*, 514*c'*. A pair of guides 201*a*, 201*c* also may be included to assist in the positioning of the extensible probes 24*a'*, 24*c'*. The guides 201*a*, 201*c* preferably may have beveled edges where needed to avoid accidentally entrapping the extensible probes.

It is desirable to avoid leading radioactive phosphorus gas into areas of the ion source vacuum chamber 30 other than the zones where an ion beam 900 is transported in order to minimize possible contamination to workers during maintenance of the extensible components. Therefore, the vacuum chamber 30 may preferably be separated into two largely isolated volumes, one volume being the zone where the ion beam 900 is located and the second volume being the zone where the extensible probes 24*a'–c'* enter the vacuum chamber 30. FIG. 3 shows an example in which an extraction electrode 301 and a ground electrode 302 are connected to the plasma chamber 4000' downstream of the plasma chamber 4000'.

Figure 4:
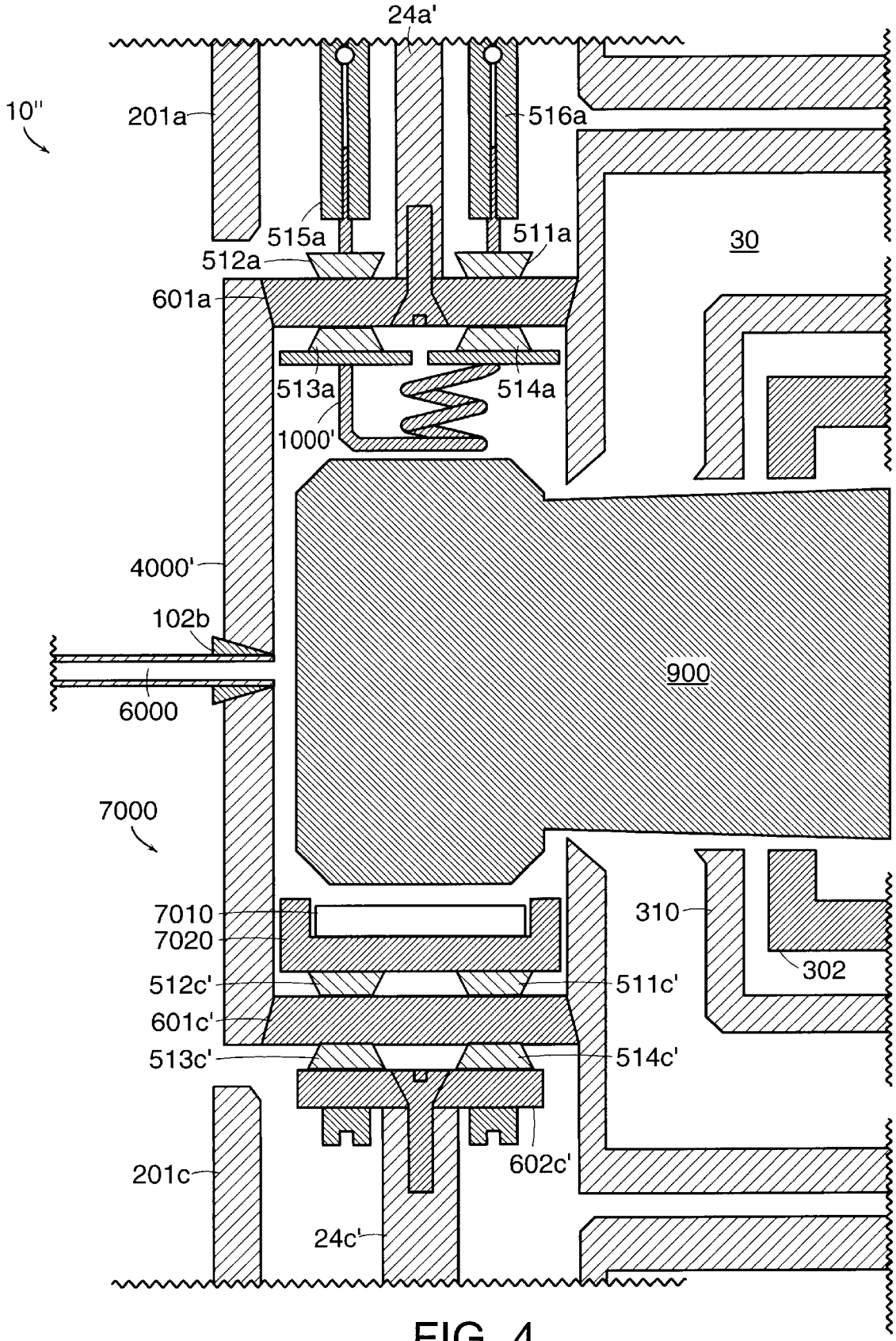
FIG. 4 is a schematic diagram illustrating an alternate embodiment for a sputter-type ion source.

FIG. 4 shows an interior portion of an ion source 10" in which a gas line 6000 connected to a source of inert gas, preferably argon, may be used instead of the vaporizer 2000' of FIG. 3. A sputter target 7000 also may be used instead of the electrostatic reflector 3000' of FIG. 3. The sputter target 7000 may be functionally and mechanically similar to the electrostatic reflector except that it may be electrically connected to a negative bias voltage, which may be varied. A radioactive material to be sputtered 7010 may be contained in a cup 7020, preferably shallow, which may be made from a material with a low sputtering coefficient, preferably graphite. The cup 7020 may be electrically insulated from the plasma chamber 4000' and the taper joint platform 601*c'* with the insulators 511*c'*, 512*c'*, 513*c'*, 514*c'*. The radioactive material to be sputtered 7010 may be any phosphorus-containing solid material that remains a solid inside the ion source, such as, for example, phosphorus dissolved in silicon or a GaP chip.

Figure 5:
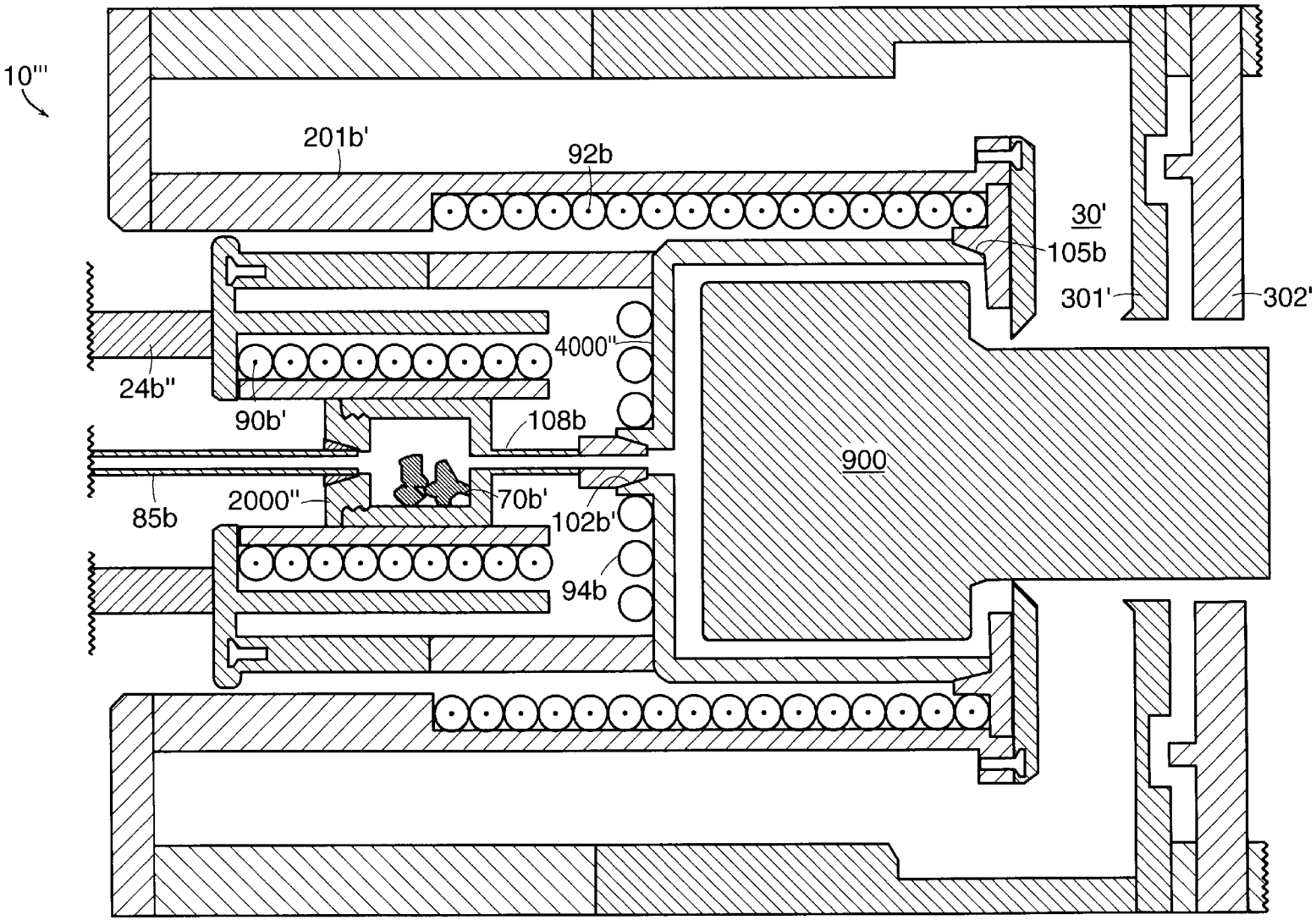
FIG. 5 is a schematic diagram illustrating an alternate embodiment of a plasma chamber for a radio frequency discharge type of ion source.

FIG. 5 shows an interior portion of an ion source 10'" that uses a radio frequency discharge to generate a plasma in a plasma chamber 4000". A solid radioactive material 70*b'* may be contained within a vaporizer 2000" and may be warmed by a heater 90*b'*. Phosphorus gas may be released to the plasma chamber 4000" through a connecting tube 108*b*, which may be joined using a taper joint 102*b'*. A separate vaporizer 2000" may preferably be employed to allow independent control of the temperature of the solid radioactive material 70*b'* compared to the temperature inside the plasma chamber 4000". In this embodiment, an inert gas, such as argon, may optionally be inserted through a tube 85*b*. The plasma chamber 4000" may be made from an electrically insulating material, preferably quartz. The plasma chamber 4000" and the vaporizer 2000" may both be mounted on an extensible probe 24*b"* and aligned into position using beveled guide 201*b'*, which may contain another heater coil 92*b*. A pair of taper joints 106*b*, 105*b* may join two sides of the plasma chamber 4000". Radio frequency power may be used to create the plasma and may be provided through coils 94*b*, which are shown in cross-section in FIG. 5. A vacuum chamber 30' may be used to isolate the volume containing the plasma and the ion beam 900 from the volume containing the extensible probe 24*b*″. The embodiment shown in FIG. 5 allows both the vaporizer 2000" and most of the plasma chamber 4000" to be mounted on the extensible probe 24*b*″ for maintenance. The vaporizer 2000" may have replacement radioactive material 70*b*′ regularly added thereto, and the plasma chamber 4000" may be periodically cleaned of any accumulated electrically conductive coating on an internal surface thereof.

Figure 6A:
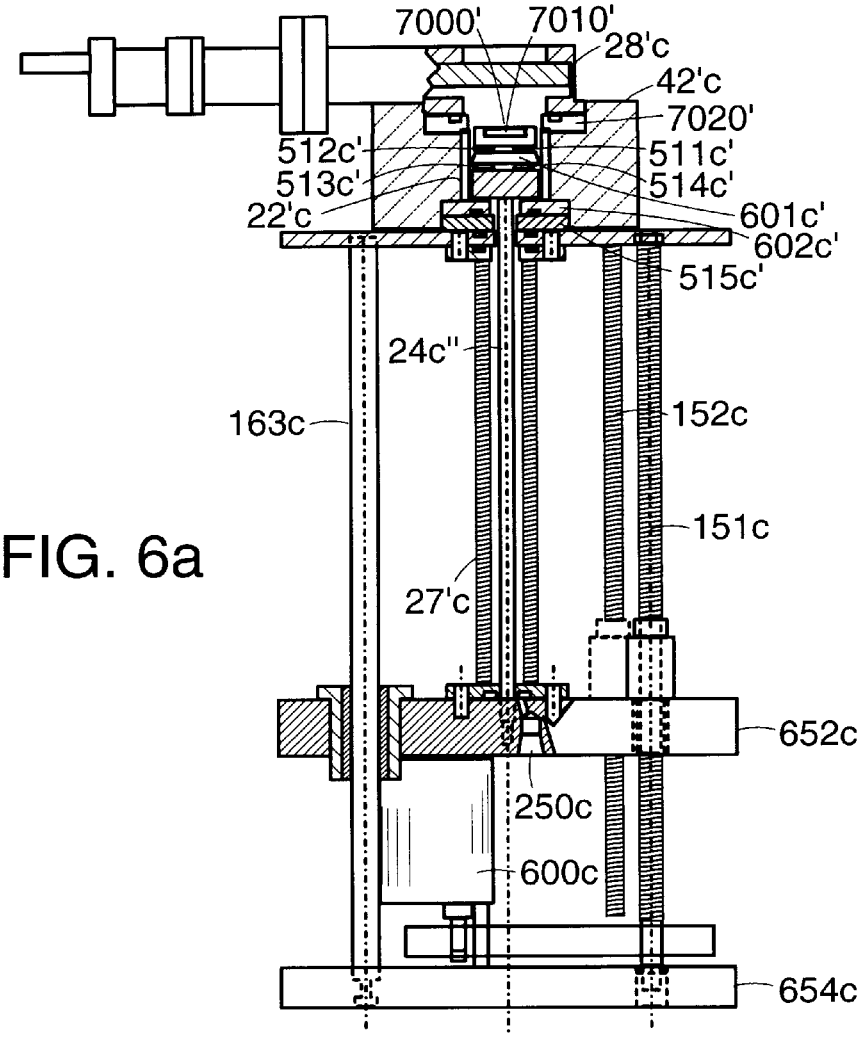
FIGS. 6*a* and 6*b* are schematic diagrams illustrating details of a preferred embodiment for a radiation shielded transfer container and enclosure for a sputter target component of an ion source.
Figure 6B:
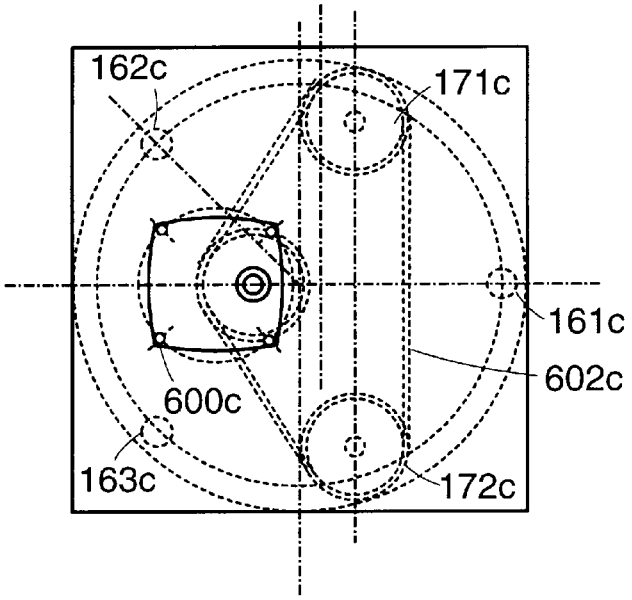

FIGS. 6*a* and 6*b* show certain additional features of an extensible probe assembly. FIG. 6*a* shows an extensible probe 24*c*″ retracted into a transfer container 22*c*′ with a closed sealable opening 28*c*′. A sputter target 7000' of the type similar to that shown in FIG. 4 may be used. In the configuration shown in FIGS. 6*a* and 6*b*, a high density shielding 42*c*′, preferably lead or machinable tungsten, may be used to protect the worker from emitted radioactivity. A subplatform 602*c*′ under a taper joint 601*c*′ may also be made from high density material, preferably machinable tungsten of sufficient thickness to lower the transmitted radiation for workers. The taper joint 601*c*′ may be coupled to a set of insulators 511*c*′, 512*c*′, 513*c*′, 514*c*′. Since FIGS. 6*a* and 6*b* are an example for the sputter target 7000', an insulation flange 515*c* may be used and may be selected to be of a material that is both vacuum compatible and electrically insulating, preferably a machinable ceramic. The insulation flange 515*c* may electrically separate the portion of the assembly consisting of the sputter target 7000', the subplatform 602*c*′, the extensible probe 24*c*″, a pair of screw shafts 151*c*, 152*c*, three guide shafts 161*c*, 162*c*, 163*c*, a base platform 654*c*, a sliding platform 652*c*, a bellows 27*c*′, and a pair of screw pulleys 171*c*, 172*c* from the rest of the system. An electrical connection of bias voltage for controlling sputtering may be conveniently attached, as appropriate. A vacuum pumpout and venting port 250*c* may preferably be located in the sliding platform 652*c* because locating the port 250*c* nearer the transfer container 22*c*′ may interfere with a complete radiation containment by the radiation shielding 42*c*′. The sliding platform 652*c* may be guided by bearings on the guide shafts 161*c*, 162*c*, 163*c* as shown in FIG. 6*b*. Motion of the sliding platform 652*c* may be effected by turning the screw pulleys 171*c*, 172*c* on the screw shafts 151*c*, 152*c*. A timing belt 602*c* may preferably be employed to ensure that the screw pulleys 171*c*, 172*c* turn at the same speed for uniform movement. A motor 600*c* may be used for turning the timing belt 602*c*. An alternate embodiment could employ a hand operated crank. The bellows 27*c*′ may preferably be used to create a variable length vacuum seal so that the extensible probe 24*c*″ may be permanently contained within the vacuum seal.

Other techniques of extending and retracting the extensible probe would be evident to persons of ordinary skill in the art. Other probes with different functionality may exhibit different means of effecting electrical and vacuum connections than the example embodiments of FIGS. 2, 6*a* and 6*b*.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

I claim:

1. An ion source assembly for generating a radioactive ion beam from solid radioactive feedstock, comprising:

a vacuum chamber comprising radioactive radiation shielding and having walls defining an interior portion, wherein said walls define at least one sealable port, a first removable transfer container comprising (i) engagement means capable of engaging and interfitting with the sealable ports thereby forming a vacuum-tight seal, wherein said engagement means defines a sealable opening corresponding to the port thereby permitting communication between the transfer container and the vacuum chamber when the container is coupled to the port, (ii) an extensible probe disposed within the container comprising an end portion capable of being extended through or proximal to the port, and (iii) radioactive radiation shielding material disposed about at least a portion of the container;

wherein the first transfer container comprises disposed on said end portion an ion-generating solid radioactive feedstock and an electrostatic electron reflector; and wherein said assembly further comprises a heat source capable of heating the solid radioactive feedstock thereby forming a radioactive vapor.

2. The ion source assembly of claim 1 further comprising a second removable transfer container comprising (i) engagement means capable of engaging and interfitting with the sealable ports thereby forming a vacuum-tight seal, wherein said engagement means defines a sealable opening corresponding to the port thereby permitting communication between the transfer container and the vacuum chamber when the container is coupled to the port, (ii) an extensible probe disposed within the container comprising an end portion capable of being extended through or proximal to the port, and (iii) radioactive radiation shielding material disposed about at least a portion of the container;

wherein the second transfer container comprises a cathode or an anode disposed on said end portion.

3. The ion source assembly of claim 2 further comprising a third removable transfer container comprising (i) engagement means capable of engaging and interfitting with the sealable ports thereby forming a vacuum-tight seal, wherein said engagement means defines a sealable opening corresponding to the port thereby permitting communication between the transfer container and the vacuum chamber when the container is coupled to the port, (ii) an extensible probe disposed within the container comprising an end portion capable of being extended through or proximal to the port, and (iii) radioactive radiation shielding material disposed about at least a portion of the container;

wherein the third transfer container comprises a cathode or an anode disposed on said end portion.

4. The ion source assembly according to claim 3 wherein the heat source for heating the radioactive feedstock is disposed in the second or third transfer container.

5. The ion source assembly of claim 1, wherein the heat source is disposed in the vacuum chamber.

6. The ion source assembly of claim 1, wherein the radioactive feedstock is disposed on a platform.

7. The ion source assembly according to claim 1 wherein said radioactive shielding comprises at least one material selected from the group consisting of aluminum, iron, tungsten, lead and alloys thereof.

8. A device for providing a radioactive feedstock to an ion source assembly, comprising:

a removable transfer container having walls defining an interior portion and an opening capable of coupling with a corresponding port on a vacuum chamber;

radioactive radiation shielding disposed on or within said walls;

an extensible probe disposed in said interior portion of said transfer container;

a solid radioactive feedstock disposed on an end of said probe; and a moveable actuator coupled to said extensible probe capable of moving the end portion into or proximal to a plasma chamber of a vacuum chamber.

9. The device of claim 8, wherein the transfer container further comprises a heating unit.

10. The device of claim 8, further comprising means for connecting vacuum or gas lines to the transfer container.

11. The device of claim 8, wherein said radioactive shielding comprises at least one material selected from the group consisting of aluminum, iron, tungsten, lead and alloys thereof.

* * * * *